United States Patent [19]

Paulus

[11] 4,165,996

[45] Aug. 28, 1979

[54] METHOD OF TREATING WIRE ROD

[75] Inventor: Philippe A. Paulus, Liege, Belgium

[73] Assignee: Centre de Recherches Metallurgiques-Centrum voor Research in de Metallurgie, Brussels, Belgium

[21] Appl. No.: 873,943

[22] Filed: Jan. 31, 1978

[30] Foreign Application Priority Data

Feb. 3, 1977 [BE] Belgium ..... 851075

[51] Int. Cl.[2] ..... C21D 9/52

[52] U.S. Cl. ..... 148/12 B; 148/156

[58] Field of Search ..... 148/12 B, 156

[56] References Cited

U.S. PATENT DOCUMENTS

| | | | |
|---|---|---|---|
| 3,783,043 | 1/1974 | Almond et al. | 148/12 B |
| 3,874,950 | 4/1975 | Grozier et al. | 148/12 B |
| 3,939,015 | 2/1976 | Grange | 148/12 B |
| 3,940,294 | 2/1976 | Sergeant | 148/12 B |
| 4,040,872 | 8/1977 | Mudiare | 148/12 B |

*Primary Examiner*—W. Stallard

*Attorney, Agent, or Firm*—Holman & Stern

[57] ABSTRACT

Wire rod is subjected to a cooling operation while emerging from a hot rolling mill. The rod is first cooled to a temperature of 850° to 650° C. and is then kept at substantially this temperature for a time sufficient for austenite to be transformed into ferrite. The rod is then cooled to a temperature of 625° to 400° C., and is kept at substantially this temperature, or allowed to cool slowly, for a time not shorter than 15 seconds and sufficiently long to permit precipitation of carbon in the form of carbides.

7 Claims, No Drawings

METHOD OF TREATING WIRE ROD

The present invention relates to a method of treating wire rod making use of the rolling heat, the method being especially applicable to wire rod consisting of mild steel, i.e., steel having a carbon content less than 0.15 wt.%.

Treatment of wire rod emerging from a hot rolling mill is a well-known process. Various methods of treating wire rod have already been suggested depending on the properties one wants to give a particular wire rod, generally with a view to avoiding a patenting operation, which is always costly. Among the methods known in this field, one should mention those in which rod while emerging from the hot rolling mill is subjected to a rapid cooling operation by means of water, down to a temperature of the order of 950° C., followed by controlled cooling (more or less intense) to a temperature sufficiently low to permit easy handling of rod coils.

These methods have been conceived to optimize the production of hard rod, in particular for eliminating lead patenting. On the other hand, these methods are unsatisfactory for mild steel rod because they are likely to harden the rod. If it is desired to decrease the hardness of this rod, the cooling speed of the rod must be considerably reduced, which results in increasing the duration of the treatment to a mostly unacceptable extent.

The present invention relates to a method of treating wire rod which, when applied to mild steel, makes it possible not only to avoid the drawbacks mentioned above, but also to give the steel a microstructure which allows the rod to be drawn very thin without intermediate annealing. This rod has a tensile strength and 0.2% yield stress lower and thus more satisfactory than those of rod consisting of the same steel and subjected to conventional controlled cooling methods. Furthermore, the elongation at fracture has average values higher and thus better than those obtained by controlled cooling methods. It should be also added that the scatter of these properties from the average is very low.

Accordingly, the invention provides a method of treating wire rod, in which the wire rod is subjected to a cooling operation while emerging from a hot rolling mill, comprising the following sequential steps:

(a) cooling down to a temperature of 850° to 650° C.;

(b) keeping the rod at substantially this temperature for a time (depending on the said temperature) sufficient for austenite to be transformed into ferrite, and optionally sufficient for grain growth to a suitable size (for example above ASTM 9);

(c) cooling from the said temperature down to a second temperature of 625° to 400° C.; and (d) keeping the rod at substantially this second temperature or slow cooling, for a time not shorter than 15 seconds and sufficiently long to permit precipitation of carbon in the form of carbides.

This treatment may be completed with an auxiliary cooling step to cool the rod down to a temperature suitable for handling wire rod coils.

The two first steps may be carried out in a single controlled cooling operation, in such a way that the rod is kept from the said time at the temperature of 850° to 650° C.

The fourth step preferably takes place at a temperature of 550° to 450° C. and for a time not shorter than 30 seconds.

Advantageously, in order to keep the wire rod at the temperature of 850° to 650° C., in step (b), the rod may be arranged in spaced turns on a conveyor, optionally within an enclosure.

In a particularly advantageous way of carrying out the cooling of the wire rod from the temperature of 850° to 650° C. down to the temperature of 625° to 400° C. in step (c), successive turns, not substantially in contact with one another, of wire rod are immersed in an aqueous bath whose temperature is higher than 75° C. and preferably substantially at its boiling point; this step is advantageously carried out by also using a conveyor moving in the aqueous bath, the rod being arranged in spaced turns on this conveyor.

The accompanying graph, not to scale, is given by way of example to illustrate the various steps of a method according to the invention.

While emerging from the rolling mill, the wire rod goes through the following stages:

(1) Cooling down to a temperature of 850° to 650° C. Deposition of the rod in spaced turns on a conveyor is effected as far as possible towards the end of step 1 so as to facilitate the cooling operation itself (lower temperature), and to reduce the length of the space required for step 2;

(2) Keeping at a given temperature in the range 850° to 650° C. (solid line) or keeping (dotted line) for the same duration (longer than 6 seconds and preferably longer than 15 seconds) within the range 850° to 650° C. to obtain this, step 2 can be carried out on a heat-insulated conveyor. The total duration of steps 1 and 2 is sufficient to permit total transformation of the austenitic structure of the rod into ferritic structure as well as satisfactory growth of the grain size. In practice, it takes at least 6 seconds to obtain a grain size larger than ASTM 9;

(3) Controlled cooling, e.g. in an aqueous bath at its boiling point, from a temperature of 850° to 650° C. to a temperature of 625° to 400° C.;

(4) Keeping for a time longer than 15 seconds, and preferably longer than 30 seconds, either at a given temperature (solid line) in this temperature range, or for the same space of time within this temperature range (dotted line).

(5) Natural cooling down to a temperature permitting easy manipulation of the turns to form coils.

By this cooling method, it is possible to give a mild steel rod in a very short time suitable mechanical properties, in particular a low yield stress, a low ratio of yield stress to tensile strength, and a high elongation at fracture.

By way of example, the following results were obtained for a mild steel containing 0.06 wt.% C and 0.25 wt.% Mn.

| Method | Yield stress (E) (kg/mm$^2$) | Tensile Strength (R) (kg/mm$^2$) | E/R |
|---|---|---|---|
| a (reference) | 26.6 | 37.8 | 0.704 |
| b (reference) | 25.8 | 36.5 | 0.708 |
| c (in accordance with the invention) | 22.1 | 32.0 | 0.700 |

The reference method a comprises cooling by blowing air onto a conveyor carrying spaced turns of wire rod laid at a temperature of 870° C. down to a coiling temperature of 160° C.

The reference method b comprises cooling as slowly as possible on a conveyor carrying spaced turns of wire rod laid at a temperature of 820° C., down to a coiling temperature of 375° C.

The method c, in accordance with the invention, has the following characteristics:

temperature at the end of the rolling operation: 950° C.;

temperature at which the turns of the wire rod are laid down on the conveyor: 825° C., temperature at the end of step 3: 750° C., duration of dwelling between 950° and 750° C. (steps 1 and 2): 17 seconds, carbon-precipitation treatment temperature (step 4): 525° C., controlled cooling duration (aqueous bath at 90° C.) between 750° and 525° C. (step 3): 12.5 seconds, duration of step 4: 60 seconds, step 5: cooling by means of blown air down to a coiling temperature of 375° C.

I claim:

1. A method of treating steel wire rod, in which the wire rod is subjected to a controlled cooling operation while emerging from a hot rolling mill, the controlled cooling operation comprising the following sequential steps:

(a) cooling the rod down to a temperature of 850° to 650° C.;

(b) keeping the rod at substantially this temperature for a time sufficient for austenite to be transformed into ferrite and for grain growth to occur;

(c) immersing the rod in an aqueous bath whose temperature is higher than 75° C.;

(d) cooling the rod, while it is in the aqueous bath, from the said temperature to a second temperature of 625° to 400° C.; and (e) keeping the rod near this second temperature for a time not shorter than 75 seconds and sufficiently long to permit precipitation of carbon in the form of carbides.

2. The method of claim 1, in which in step (e) the rod is at a temperature of 550° to 450° C. for a time not shorter than 30 seconds.

3. The method of claim 1, in which the bath is substantially at its boiling point.

4. The method of claim 1, including displacing the rod within the aqueous bath by a conveyor on which the rod is arranged in spaced turns.

5. The method of claim 1, in which the wire rod is of steel whose carbon content is lower than 0.15 wt.%.

6. The method of claim 1, in which in step (e) the rod is kept at substantially the said second temperature.

7. The method of claim 1, in which in step (e) the rod is allowed to cool slowly.

* * * * *

UNITED STATES PATENT AND TRADEMARK OFFICE

CERTIFICATE OF CORRECTION

PATENT NO. : 4,165,996

DATED : August 28, 1979

INVENTOR(S) : Philippe A. Paulus

It is certified that error appears in the above-identified patent and that said Letters Patent are hereby corrected as shown below:

Column 4, line 12, "75" should read -- 15 --.

Signed and Sealed this

*Fourth* Day of *August 1981*

[SEAL]

*Attest:*

GERALD J. MOSSINGHOFF

*Attesting Officer*

*Commissioner of Patents and Trademarks*